US006164602A

United States Patent [19]

Kuhn et al.

[11] Patent Number: 6,164,602

[45] Date of Patent: Dec. 26, 2000

[54] RAILROAD FROG ASSEMBLY WITH MULTI-POSITION HOLDBACK

[75] Inventors: Stephen R. Kuhn, Richton Park; Keith Young, Naperville, both of Ill.; Ilia Petkov, Colorado Springs, Colo.

[73] Assignee: ABC Rail Products Corporation, Chicago, Ill.

[21] Appl. No.: 09/251,841

[22] Filed: Feb. 17, 1999

[51] Int. Cl.[7] ..... E01B 7/10

[52] U.S. Cl. ..... 246/382; 246/275; 246/276; 246/257; 246/274; 246/389; 188/61; 188/31

[58] Field of Search ..... 246/275, 276, 246/257, 260, 274, 358, 387, 382, 389, 448; 188/67, 31

[56] References Cited

U.S. PATENT DOCUMENTS

| | | | |
|---|---|---|---|
| 552,916 | 1/1896 | MacPherson | 246/275 |
| 801,440 | 10/1905 | Coleman | 246/257 |
| 5,417,392 | 5/1995 | Wyatt | 246/257 |
| 5,687,935 | 11/1997 | Durchschlag et al. | 246/257 |
| 5,806,810 | 9/1998 | Young et al. | 246/276 |
| 5,988,342 | 11/1999 | Ito et al. | 192/144 |

*Primary Examiner*—S. Joseph Morano
*Assistant Examiner*—Frantz F. Jules
*Attorney, Agent, or Firm*—Thomas S. Baker, Jr.

[57] ABSTRACT

A railroad frog assembly is provided with a spring wing rail multi-position holdback subassembly that continuously retains the spring wing rail in each spring wing rail open position when activated by the wheels of a railcar traversing the frog assembly, and that automatically deactivates the multi-position holdback subassembly and releases the spring wing rail from retention in an open condition and for complete closing after the last railcar wheel has passed through the frog assembly.

5 Claims, 7 Drawing Sheets

FIG. 7
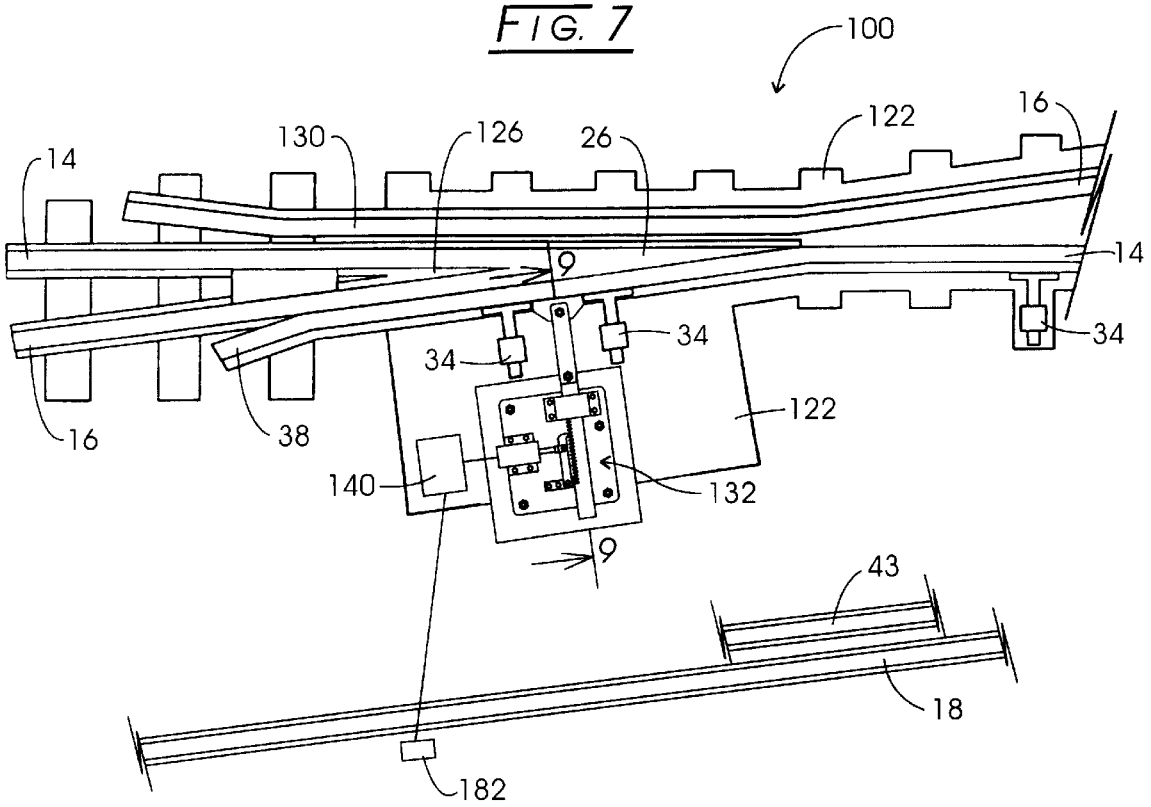
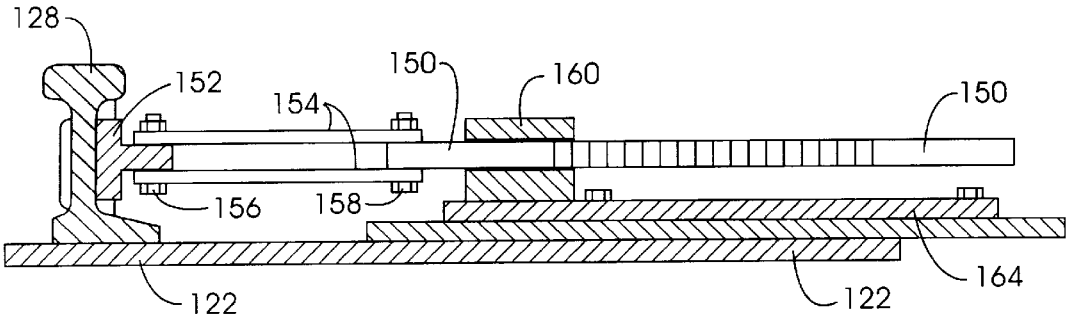
FIG. 9

RAILROAD FROG ASSEMBLY WITH MULTI-POSITION HOLDBACK

CROSS-REFERENCES

None.

FIELD OF THE INVENTION

This invention relates generally to railroad trackworks, and particularly concerns railroad frog assemblies that may be advantageously utilized in railroad trackwork intersections to obtain a prolonged operating life for each assembly.

BACKGROUND OF THE INVENTION

Numerous different configurations of fixed-point railroad frogs having spring-urged, flexible wing rails are utilized in railroad trackwork system intersections in the United States to provide through flangeways that enable railcar wheel flanges to cross intersecting rails without encountering flange physical interference.

The flanged wheels of railcars passing through a fixed-point railroad frog having a spring rail and in the direction of least traffic flow repeatedly open the included flexible wing rail by the widths of the wheel flanges, and wing rail flexure and any compression springs included in the frog alternately and repeatedly force a return of the wing rail toward its closed position. This repeated oscillating action of the conventional spring-urged wing rail is undesirable in terms of both the un-necessary frictional wear and the metal fatigue that are experienced.

Accordingly, a primary objective of the present invention is to provide a railroad frog construction having an included spring-urged flexible wing rail element with means for positively retaining the wing rail in its fully-opened position and also in each intermediate open position following its first actuation by the wheel flanges of a passing train set, and until after all the flanged wheels of the train set have passed through the frog.

Other objectives and advantages of the present invention, in addition to providing a railroad frog assembly construction with a significantly prolonged operating lifespan, will become apparent from a full consideration of the detailed descriptions, drawings, and claims which follow.

SUMMARY OF THE INVENTION

The railroad frog assembly of the present invention basically includes a frog fixed point, a frog flexible spring wing rail that abuts the frog fixed point when in a wing rail fully-closed position and that is spaced apart from the frog fixed point by the width of a railcar wheel flange when flexed to a wing rail fully-opened position, a multi-position holdback subassembly that continuously snubs the frog spring wing rail until deactivated, and a control means responsive to railcar wheel flanges passing through the frog assembly to automatically and with delay deactivate the holdback subassembly to thereby initiate release the frog spring wing rail from its flexed position after the last railcar wheel of passing train of railcars has cleared the frog assembly The multi-position holdback subassembly incorporated in the railroad frog assembly of the present invention typically takes the form of either a friction-type multi-position holdback subassembly or a toothed, ratchet-type multi-position subassembly.

BRIEF DESCRIPTION OF THE DRAWINGS

FIG. 7 is a schematic plan view similar to FIG. 2 but of an alternate embodiment of the railroad frog assembly of the present invention incorporating a toothed, ratchet-type multi-position holdback subassembly rather than a friction-type multi-position holdback subassembly;

FIG. 9 is a section view taken at line 9—9 of FIG. 7; and

DETAILED DESCRIPTION

Figure 1:
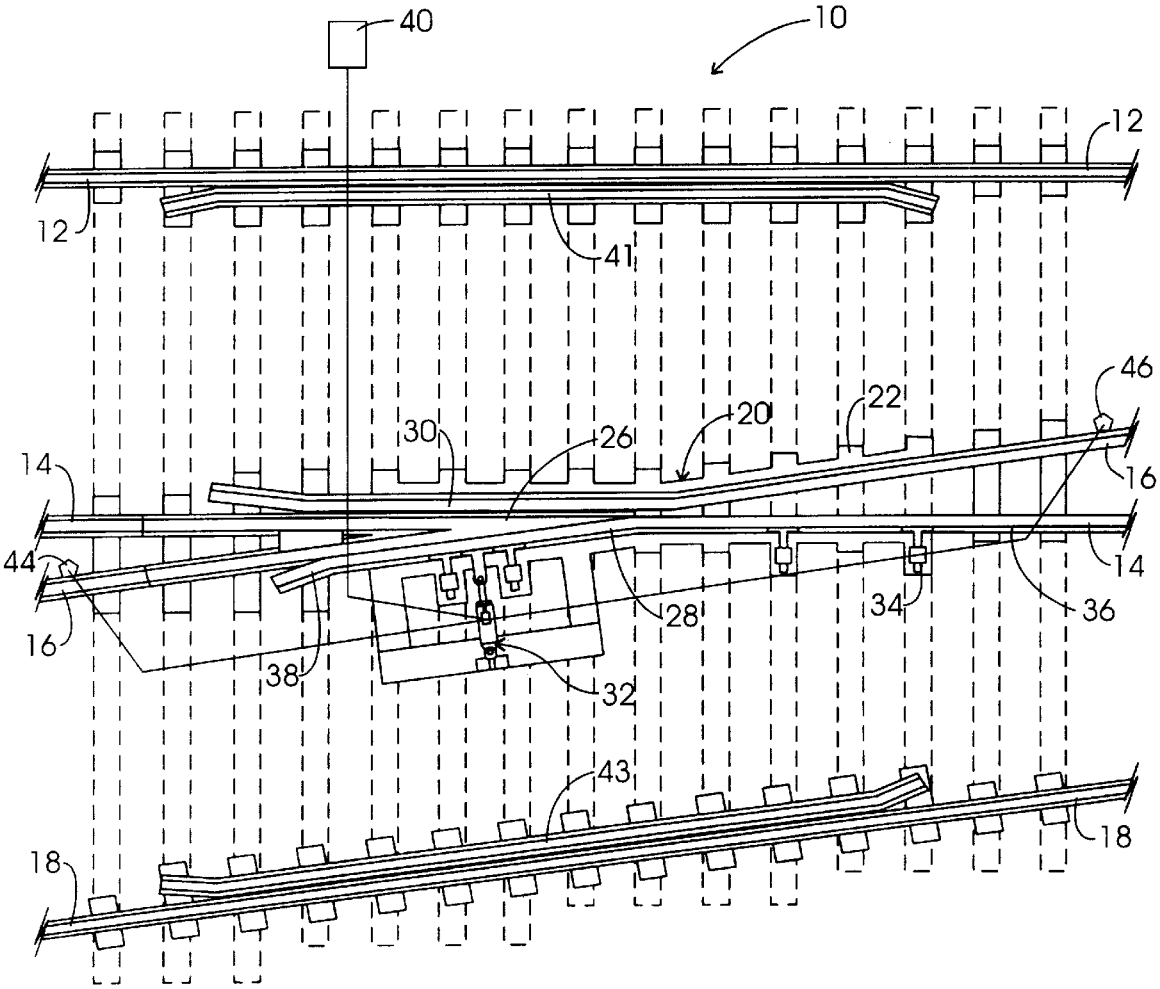
FIG. 1 is a schematic plan view of a section of railroad trackwork having one embodiment of the railroad frog assembly of the present invention incorporated therein.
Figure 2:
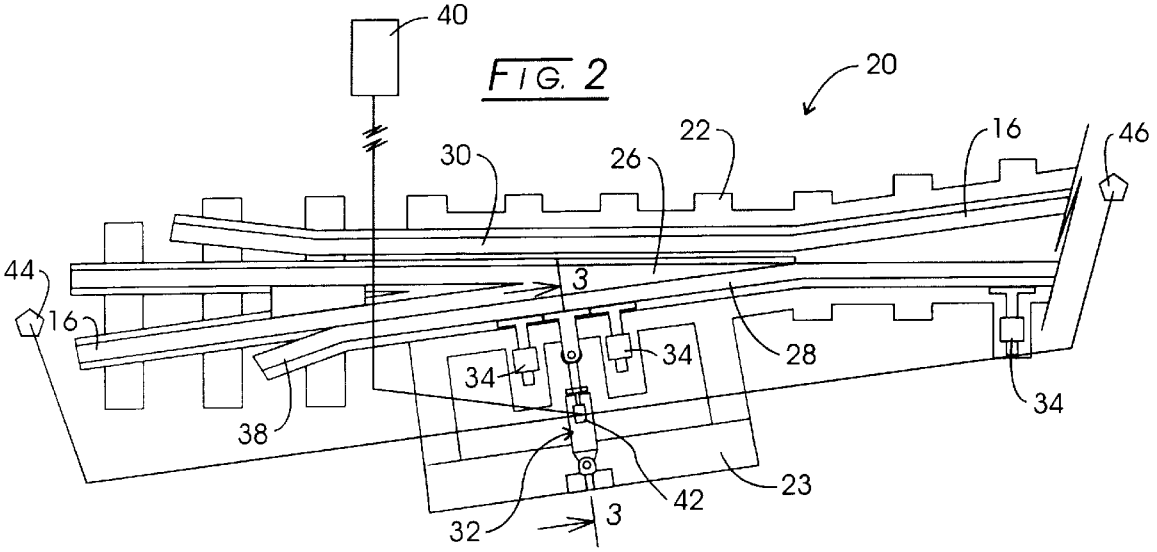
FIG. 2 more clearly illustrates the railroad frog assembly included in the railroad trackwork section of FIG. 1.

FIG. 1 illustrates a left-hand railroad trackwork intersection 10 having a pair of main traffic rails 12 and 14 and a pair of turnout traffic rails 16 and 18 in which main traffic rail 14 intersects turnout traffic rail 16 at the frog assembly 20 of the present invention. Referring to FIG. 2, frog assembly 20 is basically comprised of a base plate element 22, a frog fixed point 26 (sometimes referred to as a frog "V-point") carried by the base plate, a laterally-movable frog spring wing rail 28, a frog fixed wing rail 30 also supported by base plate element 22, and a wedged ball, friction-type multi-position holdback subassembly 32 connected to spring wing rail 28.

In FIGS. 1 and 2, flexible spring wing rail 28 is illustrated in its closed position but when moved to an "open" position creates a cross-over flangeway through assembly 10 for the flanges of railcar wheels riding on turnout traffic rail 16. Flexible spring wing rail 28 essentially abuts the side of fixed point 26 when in its closed position, and is flexed or pivoted laterally about the point designated 36 to an open flangeway condition whenever the flange of a railcar wheel traversing the frog assembly either first engages the side of closed flexible wing rail 28 to the right of V-point 26 or engages the side of movable wing rail element 28 at its flared end portion 38.

Also included in railroad trackwork intersection 10, but not comprising a part of the present invention, are conventional intersection rigid guard rails 41 and 43. Also, conventional spring wing rail holddown subassemblies 34 and conventional supplementary compression spring closer elements (not shown) may optionally be incorporated into frog assembly 20 but are not the basis of the novelty of the present invention.

Frog assembly 20 also includes a control system 40 that is connected to a source of electrical power (not shown), and that includes solenoid actuator 42 in holdback subassembly 32 and proximity sensor switches 44 and 46. Details of control system 40 are provided in and discussed with respect to FIG. 6 of the drawings.

Figure 3:
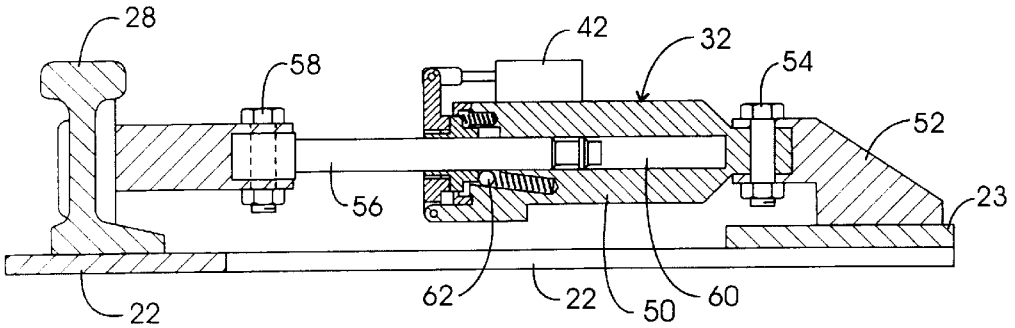
FIG. 3 is a section view taken at line 3—3 of FIG. 2.

As shown in FIG. 3, holdback subassembly 32 is comprised of a body element 50 which is pivotally connected to bracket 52 by threaded bolt 54, and of a rod element 56 which is pivotally connected to an extension of spring wing rail 28 by threaded bolt 58 that is slidably positioned in the interior bore 60 of body element 50. Also positioned interiorly of body element 50 are multiple retention friction-ball elements 62 (of which only one appears in section FIGS. 4 and 5) which may be as many as three or even four in number. Such friction-ball elements are spaced-apart circumferentially with respect to the exterior surface of rod element 56 and contact that surface continuously except when solenoid actuator 42 is activated to release spring wing rail 26 from retention in a flexed and open condition. In instances where it is preferred to locate multi-position holdback subassembly 32 between adjacent trackwork ties, frog assembly 20 may be provided with a cross-plate 23 that is welded to base plate 22 and to which bracket 52 may be attached.

Figure 4:
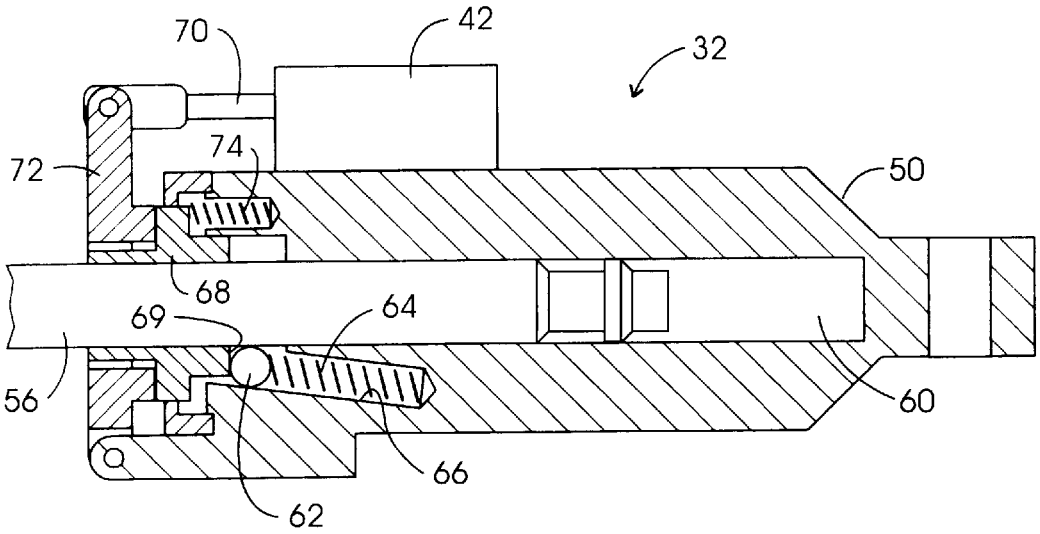
FIGS. 4 and 5 are fragmentary section views of the releasable, friction-type multi-position holdback subassembly incorporated in the FIGS. 1 and 2 frog configuration respectively in its activated and deactivated operating conditions.

Also as illustrated in FIG. 4, retention friction-ball elements 62 are normally urged into contact with the surface of rod element 56 by the influence of included compression spring elements 64 that are contained and compressed in angled internal body bore 66. Essentially, the constant frictional snubbing engagement of friction-ball elements 62 with the exterior cylindrical surface of rod element 56 is effected by the wedging actions of compression springs 66 that force those ball elements into their respectively narrowing gaps between the radially outward walls of angled bores 66 and the adjacent surface rod element 56. Also, and because of frictional forces applied tangentially to friction-ball elements 62 from the contacting exterior surface of rod element 56, such ball elements are urged further toward the wedge area creating additional gripping action as rod element 56 is withdrawn from within body element interior bore 60. Conversely, and as rod element 56 slides further into bore 60 at any time, applied tangential friction forces then tend to roll ball elements 62 away from the holdback subassembly body 50 internal wedge zone to thereby reduce the forceful gripping of rod element 56 which is connected to spring wing rail element 28.

Thus, and in the absence of activation of solenoid actuator 42 by control system 40, friction-ball elements 62 of friction-type holdback subassembly 32 are maintained in constant wedged and substantial frictional engagement with rod element 56.

Figure 5:
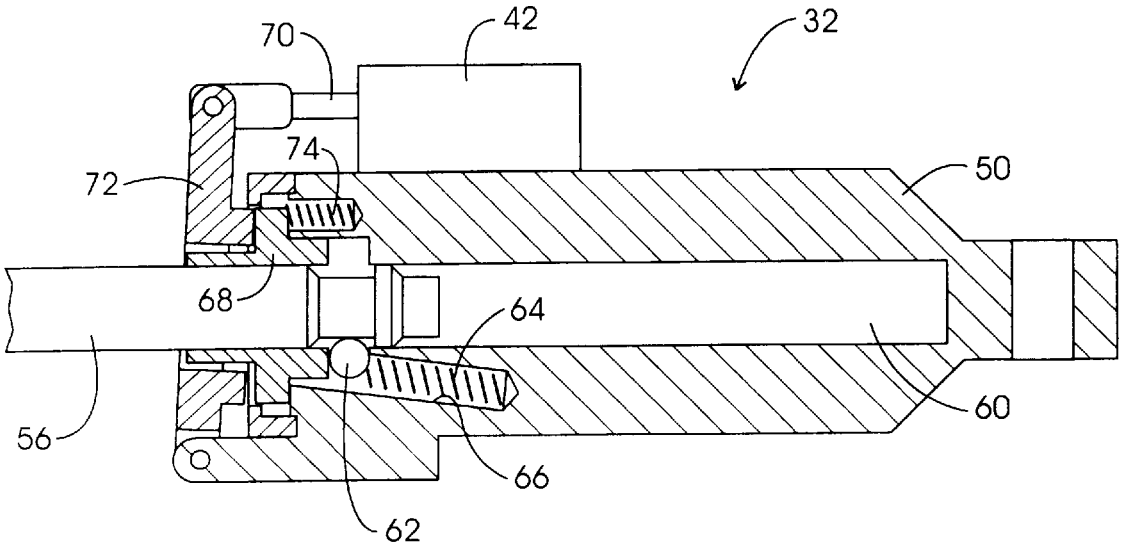

In order to effect a release of friction-ball element 62 from their contacting engagement with the exterior cylindrical surface of rod element 56, an included slidable end-closure member 68 is moved rightwardly relative to rod element 56 from its FIG. 4 position to the position illustrated in FIG. 5 by the control system activation of solenoid actuator 42, and such causes friction-ball elements 62 to be released from their normal wedged position holding spring wing rail 28 in an open condition.

The release action of solenoid actuator 42 is achieved by the drawing of its plunger 70 into an internal electromagnetic coil and consequent movement of the connected ring-type actuator arm 72 that abuts end-closure member 68. Internal compression springs 74 contact the interior face of member 68 and are provided to assure that there is clearance between that member and retention friction-ball elements 62 other than when solenoid actuator 42 is activated.

Figure 6:
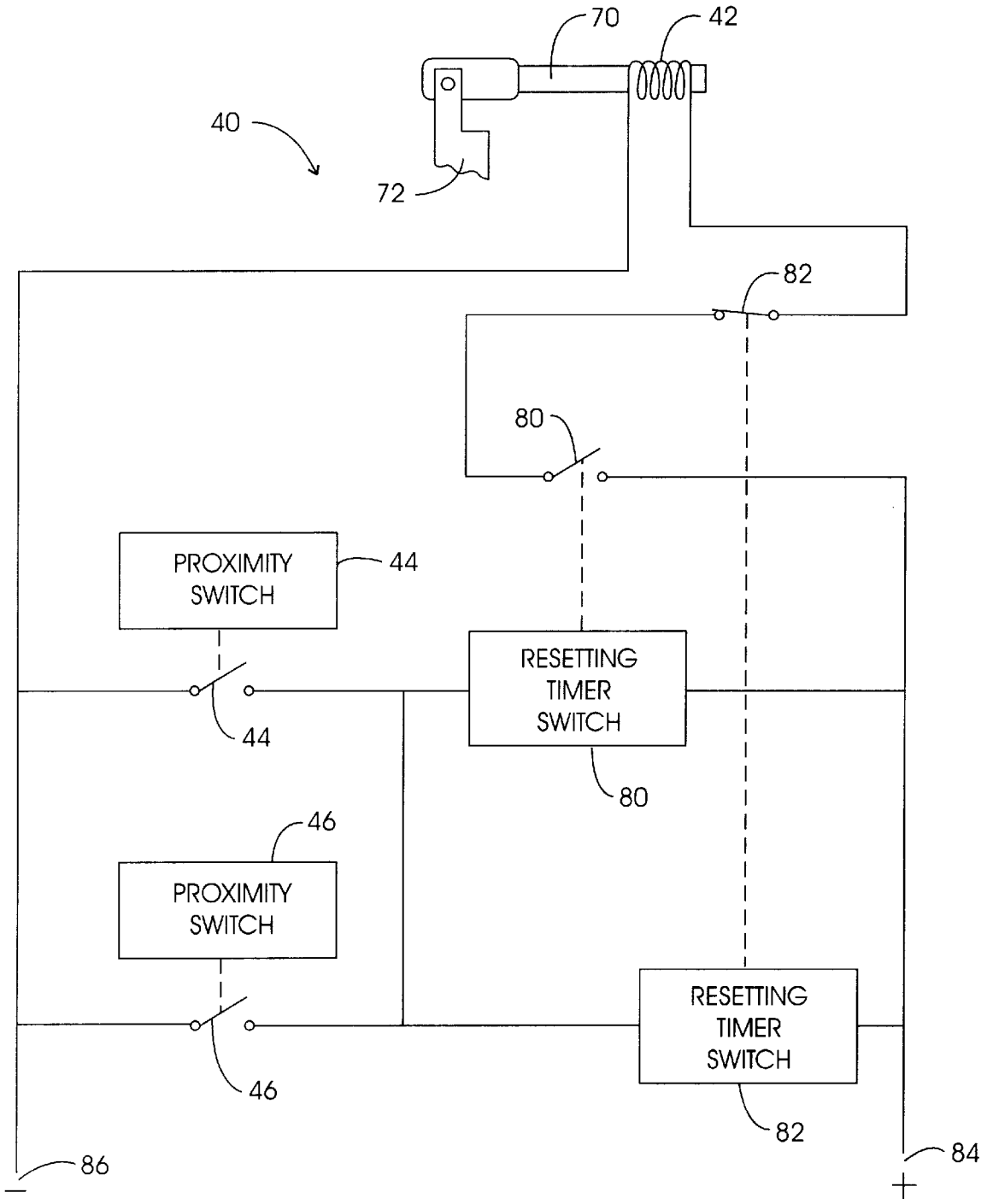
FIG. 6 is a schematic illustration of the electrical control system included in the railroad frog assembly of FIGS. 1 and 2.

Referring to FIG. 6, electrical control system 40 is essentially comprised of wheel sensor switches 44 and 46, resetting timer switches 80 and 82, actuator solenoid 42, and circuit conductors interconnecting those components to the positive and negative terminals 84 and 86 of a conventional electrical power source in the manner shown. Sensor switches 44 and 46 may each have a conventional proximity switch configuration, a conventional load cell configuration, or the like—their function in the invention being to detect and positively respond to the presence a an adjacently-positioned railcar wheel. The railroad frog assembly system sensors preferably are positioned adjacent the exterior side of turnout traffic rail 16, which rail is most often a traffic rail of least traffic density, and each functions to sense the immediate presence or absence of a flanged railcar wheel passing through the intersection. If the immediate presence of a railcar wheel is sensed by a proximity switch or load cell, that component's switch element is closed, otherwise the sensor switch element normally remains open.

Sensor switches 44 and 46 function to complete a power circuit to and through a respective one of resetting timer switches 80 and 82. Timer switch 80 is a normally-open type switch, timer switch is 82 is a normally-closed type switch, and such timer switches are preferably of an adjustable type, and have different pre-set time periods for switch element closure with switch 82 having a significantly shorter set time duration than the time duration set for switch 80. A time-difference period of approximately 15 to 30 seconds normally is adequate to energize solenoid actuator 42 with assurance that rod element 56 will be released for sufficient time to permit spring wing rail 28 to be fully returned to its closed condition.

Thus, an electrical circuit through solenoid actuator 42 is not completed until after the last rail car wheel passing through frog assembly 20 in either direction no longer influences a sensor 44 or 46 positioned beyond the limits of assembly 20. When both of sensors 44 and 46 become deactivated, solenoid actuator 42 becomes energized for only a brief period of time corresponding to the time difference existing between the time periods set in timer switches 80 and 82. Thereafter, solenoid actuator 42 is returned to its non-energized and non-actuated condition.

FIG. 7 illustrates an alternate embodiment of the present invention which is referenced as 100 in the drawings and which, in terms of end objectives, functions in the manner of railroad frog assembly 20 of FIG. 2. Assembly 100 is basically comprised of base plate element 122, a frog fixed point 126 carried by the base plate, a laterally-movable frog spring wing rail 128, a frog fixed wing rail 130 also supported by base plate element 122, and spring wing rail multi-position holdback subassembly 132. Subassembly 132 differs from subassembly embodiment 32 in that it is a "toothed" ratchet-type of multi-position holdback rather than a friction-type multi-position holdback. Construction differences between the two types of multi-position holdbacks are best noted during comparison of FIGS. 8 and 9 of the drawings with FIGS. 3 through 5.

In FIG. 7, flexible spring wing rail 128 is illustrated in its closed position, and when moved to an "open" position creates a cross-over flangeway through assembly 100 for the flanges of railcar wheels riding on turnout traffic rail 16. Flexible spring wing rail 128 essentially abuts the side of fixed point 26 when in its closed position, and is flexed or pivoted laterally about the point designated 36 to an open condition whenever the flange of a railcar wheel traversing the frog assembly either first engages the side of movable wing rail 28 to the right of V-point 26 or engages the side of movable wing rail element 28 at its flared end portion 38.

Spring wing rail frog assembly 100 also includes a control system 140 that is hydraulic in nature rather than electrical-electronic as is control system 40. Control system 140 functions to regulate ratchet holdback subassembly 132 between its activated and deactivated conditions. Also, control system 140 is particularly distinguished by the inclusion of a wheel-activated, single-acting, spring-return mechanical hydraulic pump element 182 that functions both as a sensor of the presence or absence of each railcar wheel passing through frog assembly 100 and as an energy source for powering control system 140. FIG. 7 also shows, schematically, the preferred placement of wheel-activated hydraulic pump element 182 in a position that is adjacent outboard turnout traffic rail 18. Alternatively, a pair of such mechanical hydraulic pump elements may be utilized in a particular frog assembly installation such being located to each traffic side of frog assembly 100.

Figure 8:
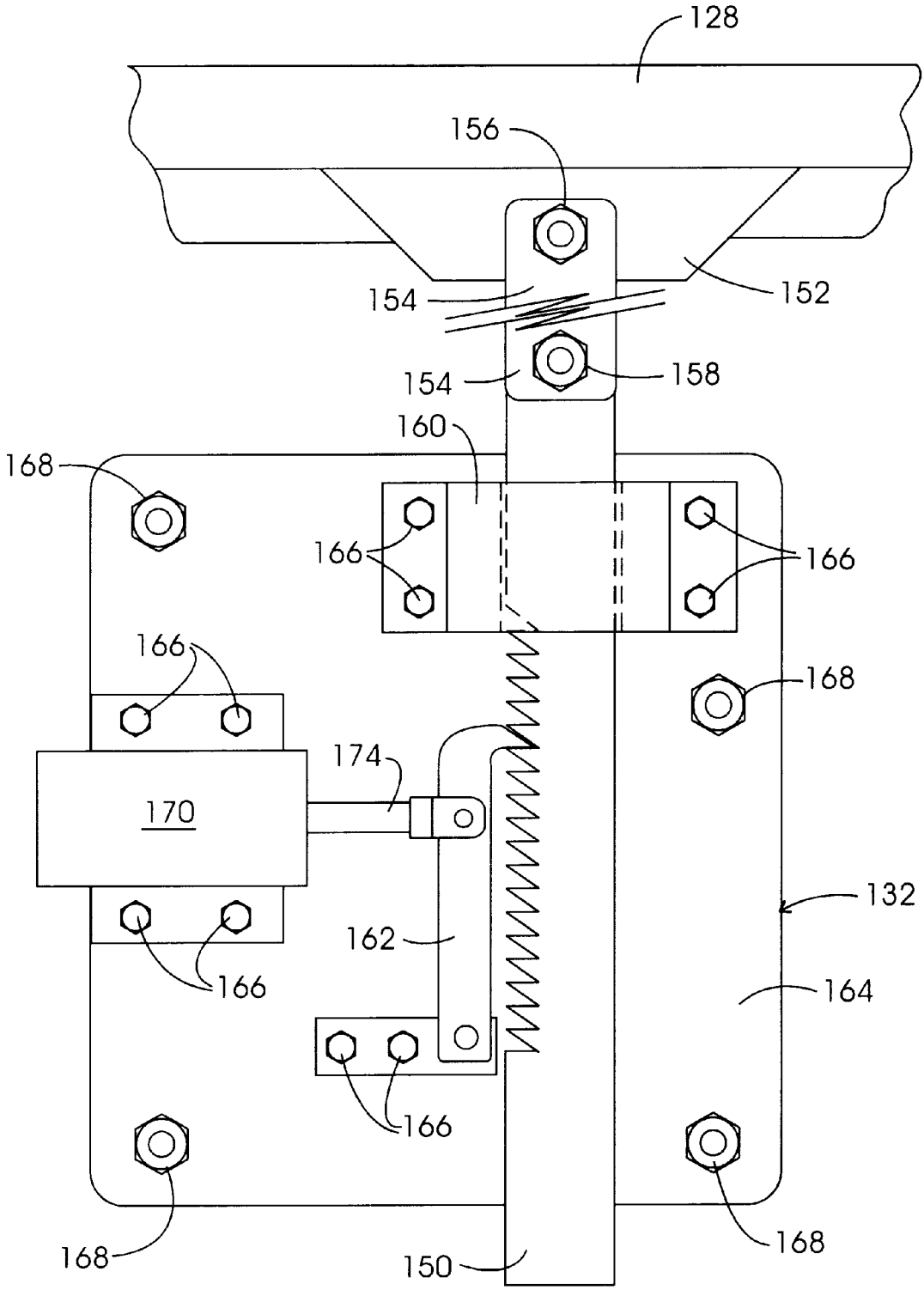
FIG. 8 is a fragmentary plan view of a portion of the FIG. 7 plan view but illustrating the included toothed, ratchet-type multi-position holdback subassembly at larger scale.

As shown in FIG. 8, multi-position holdback subassembly 132 is comprised of a toothed rod element 150 that is connected to bracket 152 attached to spring wing rail section 128 through paired connecting links 154 and threaded pivot bolt fasteners 156 and 158, a co-operating rod-guide and holddown 160 which restrains rod element 150 relative to its principal axis both vertically and transversely but not longitudinally and slidably, and also a pivoted ratchet retention pawl element 162 which selectively engages and restrains rod element 150 against movement in one direction only when activated. Elements 160 and 162 are mounted on ratchet holdback base element 164 by threaded bolt fasteners 166. Base element 164 in turn is mounted on frog base plate element 122 by threaded fasteners 168.

Also included in ratchet holdback subassembly 132 is hydraulic actuator element 170 whose interior piston 172 and joined piston rod element 174 are spring-biased in a direction away from rod element 150 by internal compression spring 176. (See FIG. 10). Spring 176, in the absence of pressurized hydraulic fluid in the opposite interior end of actuator 170, functions to deactivate ratchet subassembly 132 by moving ratchet retention pawl 162 out of engagement with the ratchet teeth of toothed ratchet rod element 150. Actuator piston rod element 174 is pivotally attached at its free end to pivoted ratchet pawl element 162.

Spring wing rail 128 is moved to an open condition by engagement with a railcar wheel flange pawl element 162, and the concurrent pressurization of hydraulic control system 140 by the actuation of hydraulic pump element 182 by the wheels of the passing railcar, piston/piston rod combination 172–174 move ratchet pawl element 162 into engagement with the teeth of ratchet rod element 150. However, forces originated by the engaged wheel flanges of the passing railcar are of a large magnitude, and as transmitted into ratchet rod element 150 are sufficient for the rod element and its included teeth to overcome the pawl engagement forces generated in hydraulic actuator 170 thereby permitting successive engaged teeth of ratchet rod element 150 to move past ratchet retention pawl element 162 in a wing rail-opening direction without restraint. However, all movement of the ratchet rod element in an opposite or wing rail-closing direction is restrained by ratchet pawl element 162 and its indirect connection to the frog assembly base plate 122 until such time as ratchet subassembly 132 is deactivated by substantially reducing the pressure of the hydraulic fluid previously generated within hydraulic actuator 170 by control system 140.

Figure 10:
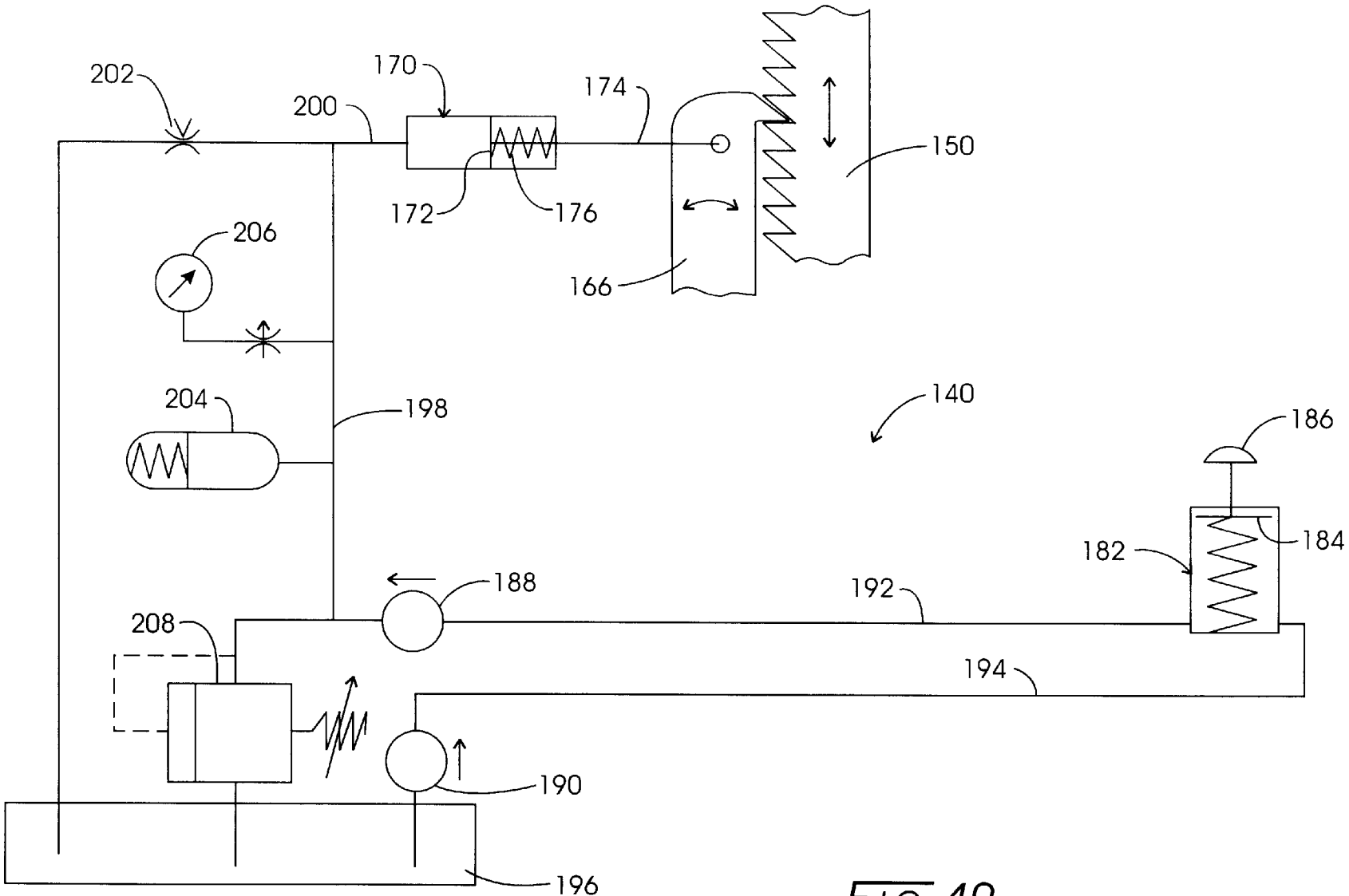
FIG. 10 is a schematic illustration of the hydraulic control system included in the railroad frog assembly of FIG. 7.

Details of hydraulic control system 140 are provided in FIG. 10 of the drawings. Hydraulic pump 182 has an internal piston 184 that is connected to reciprocable, wheel-actuated plunger element 186. Pump 182 is made a single-acting pump be reason of check valves 188 and 190 included in hydraulic fluid flow lines 192 and 194. The internal compression spring element of hydraulic pump 182, in the absence of wheel tread forces imposed on plunger element 186, urges piston element 184 to the position shown in FIG. 10.

As the wheel treads of successive railcars passing through frog assembly 100 repeatedly depress plunger element 186, pressurized hydraulic fluid is pumped from reservoir 196 to single-acting, spring-return hydraulic actuator 170 via fluid flow lines 198 and 200.

Hydraulic control system 140 also includes and adjustable bleed-off valve 202, a conventional spring-powered pressure accumulator 204, a valved pressure gage 206, and an adjustable pressure relief valve 208 set for system maximum pressure. System relief valve 208 is set to hold a control system activating pressure that is greater than the pressure required at actuator 170 to overcome the spring forces of actuator compression spring 176 and thereby maintain ratchet retention pawl element 162 actively engaged with the teeth of ratchet rod element 150 but not so high as to materially oppose the forces of ratchet rod element 150 that move that element in a spring wing rail-opening direction. Bleed-off valve 202 is preferably adjusted to control the rate of fluid flow from line 200 where such rate establishes a predetermined time delay (e.g., 45 seconds) between the time that the last railcar wheel of a train set passing through from assembly 100 depresses pump plunger 186 and the time that ratchet assembly 132 is returned to its fully-deactivated condition.

Various changes may be made in the relative shapes, proportions, and sizes of the components disclosed without departing from the scope, meaning, or intent of the claims which follow.

We claim our invention as follows:

1. A railroad trackwork frog assembly comprising:

a frog fixed point element;

a frog base plate element;

a frog spring wing rail element that may be flexed laterally from a closed position abutting said frog fixed point element to an open condition separated from said frog fixed point element by a minimum distance equal to the width of a railcar wheel flange;

a multiple stop position ratchet latch holdback subassembly coupled to said frog spring wing rail element and to said frog base plate element, and continuously retaining said frog spring wing rail element in a spring wing rail open condition when activated; and control means selectively deactivating said multiple stop position ratchet latch holdback subassembly, said control means deactivating said multiple stop position ratchet latch holdback subassembly following the passing of the last railcar wheel of each train passing through the frog assembly to thereby initiate the spring return of said spring wing rail element from the open condition to a closed condition.

2. The railroad frog assembly defined by claim 1, and wherein said multiple stop position ratchet latch holdback subassembly comprises: a body element, a rod element slidably positioned in said body element, and retention friction-ball elements that are spring-urged into wedged frictional contact with said rod element when said multi-position ratchet latch holdback subassembly is activated.

3. The railroad frog assembly defined by claim 2, and further comprised of a control system having an electrical solenoid actuator element, said electrical solenoid actuator element, when electrically energized, disengaging said retention friction-ball elements from wedged frictional contact with said multi-position mechanical latch holdback subassembly rod element.

4. The railroad frog assembly defined by claim 1, and wherein said multiple stop position ratchet latch holdback subassembly comprises a toothed ratchet rod element coupled to said spring wing rail element, a ratchet retention pawl element pivotally carried by said frog base plate element and selectively engageable with said toothed ratchet rod element, and an actuator element connected to said ratchet retention pawl element, said ratchet retention pawl element being engaged with said toothed ratchet rod element when said multi-position ratchet latch holdback subassembly is activated.

5. The railroad frog assembly defined by claim 4, and further comprised of a control system having a wheel-actuated hydraulic pump, said wheel-actuated hydraulic pump, when delivering pressurized hydraulic fluid, activating said multiple stop position ratchet latch holdback subassembly and engaging said ratchet retention pawl element with said toothed ratchet rod element.

* * * * *